US006580208B2

(12) United States Patent
Nelle

(10) Patent No.: US 6,580,208 B2
(45) Date of Patent: Jun. 17, 2003

(54) DEFLECTION UNIT FOR COLOR CATHODE RAY TUBES

(75) Inventor: Friedrich-Karl Nelle, Stuttgart (DE)

(73) Assignee: Matsushita Display Devices (Germany) GmbH, Esslingen (DE)

( * ) Notice: Subject to any disclaimer, the term of this patent is extended or adjusted under 35 U.S.C. 154(b) by 0 days.

(21) Appl. No.: 09/821,746

(22) Filed: Mar. 29, 2001

(65) Prior Publication Data

US 2001/0040427 A1 Nov. 15, 2001

(30) Foreign Application Priority Data

Mar. 29, 2000 (EP) ..... 00106713

(51) Int. Cl.[7] ..... H01J 29/46

(52) U.S. Cl. ..... 313/442; 313/440; 335/209; 335/210; 335/211; 335/213

(58) Field of Search ..... 313/448, 460, 313/442, 495, 2.1, 440; 349/139; 335/209, 210, 211, 213

(56) References Cited

U.S. PATENT DOCUMENTS

| | | | | | |
|---|---|---|---|---|---|
| 3,714,500 | A | * | 1/1973 | Kaashoek | 315/368.18 |
| 4,763,040 | A | * | 8/1988 | Vink et al. | 313/428 |
| 4,789,806 | A | * | 12/1988 | Meershoek | 313/440 |
| 4,839,568 | A | * | 6/1989 | Dumesnil et al. | 315/368.23 |
| 4,866,336 | A | * | 9/1989 | Sluyterman | 313/431 |
| 5,027,042 | A | * | 6/1991 | Sluyterman et al. | 313/412 |
| 5,355,050 | A | * | 10/1994 | Sluyterman | 313/413 |
| 5,506,469 | A | * | 4/1996 | Vink et al. | 313/440 |
| 5,847,503 | A | | 12/1998 | Roussel et al. | |
| 6,046,713 | A | * | 4/2000 | Jamar | 313/413 |

FOREIGN PATENT DOCUMENTS

| | | |
|---|---|---|
| EP | 0 178 976 | 4/1986 |
| EP | 0 540 113 | 5/1993 |
| FR | 2757678 | 6/1998 |
| FR | 2757680 | 6/1998 |
| FR | 2757681 | 6/1998 |

* cited by examiner

*Primary Examiner*—David Martin
*Assistant Examiner*—Thanh Y. Tran
(74) *Attorney, Agent, or Firm*—Boyle Fredrickson Newholm Stein & Gratz S.C.

(57) ABSTRACT

The present invention refers to a deflection unit for mounting on a color cathode ray tube, an associated tube and a corresponding display apparatus. The deflection unit comprises a pair of coils for vertical deflection and a pair of coils for horizontal deflection. At least one of the pair of coils is subdivided into at least two parts, of which one part is intended for the correction of convergence errors and the other part for the correction of geometry errors. The respective corrections can be carried out independently of the respectively other correction. According to a preferred embodiment the parts are spatially separated and mechanically independent, with the part intended for geometry error correction being positioned closer to the screen of the picture tube. Preferred is the use of an in-line type arrangement of the saddle-saddle or saddle-toroidal type.

15 Claims, 5 Drawing Sheets

DEFLECTION UNIT FOR COLOR CATHODE RAY TUBES

BACKGROUND OF THE INVENTION

1. Field of the Invention

The present invention relates in general to a deflection unit for mounting on a color cathode ray tube and is in particular concerned with the correction of convergence errors and geometry errors in such a deflection unit.

2. Description of the Related Art

Deflection units are mounted on a cathode ray tube to deflect the electron beams across the screen in X- and Y-direction. The deflection unit consists essentially of two pairs of coils and a ferrite core for returning the magnetic flux. The one pair of coils produces a magnetic field which deflects the electron beams in horizontal direction (X-direction) whereas the other pair of coils serves vertical deflection (Y-direction).

A constructional form often used for modern color picture tubes is the in-line type arrangement in which the beam generating systems are arranged in one plane side by side. In such systems three electron beams are generated whose axes extend in coplanar fashion and which converge on the screen. The picture produced by deflection units suited for this type of color picture tubes is self-converging, coma-free and essentially without any north-south raster distortions. This is essentially achieved by a field shape varying in the Z-direction. The Z-direction is here the axis extending towards the screen.

FIGS. 1*a* and 1*b* illustrate the deflection fields for the vertical and horizontal deflection direction in a deflection unit for in-line type color picture tubes. As can be seen in the figures, the field distributions in the rear portions 10, 40 of the deflection unit differ from those of the central portion 20 and the front portion 30, 50 of the deflection unit.

The field shapes which can be employed for use in such deflection units are shown in FIG. 1*c,* the left field distributions being pincushion-shaped and the right ones barrel-shaped. The upper field distributions shown in FIG. 1*c* are used for the vertical deflection direction whereas the lower field distributions are employed for horizontal deflection.

As can be learned from FIG. 1*a,* a pincushion-shaped deflection field is used for the vertical deflection direction in the rear portion of the deflection unit, a barrel-shaped deflection field is used in the central portion, and a pincushion-shaped deflection field is again used in the front portion. For the horizontal deflection direction the deflection unit as shown in FIG. 1*b* comprises a barrel-shaped deflection field in the rear portion and a pincushion-shaped deflection field in the front portion. As described above, a self-converging picture which is free of coma errors and north-south raster distortions is obtained through said arrangements.

Essentially two types of errors may arise due to construction errors in the picture tubes and deflection units: convergence errors and geometry errors. Convergence errors are observed whenever the primary color images have no congruent rasters any more. By contrast, geometry errors arise whenever the raster image is shown in distorted form on the screen. Convergence and geometry errors may also occur at the same time.

An example of the presence of convergence errors is shown in FIG. 2 where due to construction tolerances the blue beam can no longer be made congruent with the read beam. For the correction of such a convergence error the deflection unit is normally tilted in conventional assemblies, as shown in FIGS. 3*a* and 3*b* for the X-direction and Y-direction, respectively.

Such an error correction has the drawback that undesired asymmetrical geometry errors may be produced because of the inhomogeneous fields in the front portion of the deflection unit. This is further illustrated with reference to FIGS. 4*a* and 4*b*. FIG. 4*a* shows an ideal raster and FIG. 4*b* a distorted raster created by tilting the deflection unit in the Y-direction.

Another prior-art correction device for coma errors created by the difference in the raster dimensions of the three electron beams in the in-line type, which is due to the eccentric position of the outer in-line guns, based on the horizontal and vertical deflection fields, comprises an additional pair of coils which are mechanically fixed onto the rear side of the deflection unit. This pair of coils permits a correction of the convergence error by means of suitable circuitry measures. Although the additional pair of coils allows convergence corrections without substantially affecting the geometry, the circuitry measures required therefore are very complicated.

OBJECTS AND SUMMARY OF THE INVENTION

It is therefore the object of the present invention to provide a simplified deflection unit for mounting on a color cathode ray tube which permits an improved convergence and geometry error correction. Another object of the invention consists in providing associated color cathode ray tubes and display apparatuses.

According to the invention a deflection unit for mounting on a color cathode ray tube comprises a pair of coils for vertical deflection and a pair of coils for horizontal deflection, with at least one of the pairs of coils being divided into at least two parts. One part serves the correction of convergence errors and the other part the correction of geometry errors. The respective corrections can be made independently of the respectively other correction.

This arrangement according to the invention has the advantage that it permits a convergence correction without producing a considerable geometry error.

Moreover, thanks to the separate adjustment of the two types of errors, highly sensitive deflection units can be realized, in particular, also with respect to a correction of the coma error.

In preferred embodiments the two parts are mechanically independent and spatially separated from each other, the part intended for the correction of the geometry errors being positioned closer to the screen plane than the part intended for the correction of the convergence errors.

To obtain different correction characteristics it is here possible to subdivide either only the pair of coils for vertical deflection or only the pair of coils for horizontal deflection or both pairs of coils.

Preferred embodiments are defined in the subclaims.

BRIEF DESCRIPTION OF THE DRAWINGS

The invention shall now be explained with reference to the attached drawings, in which.

DETAILED DESCRIPTION OF THE PREFERRED EMBODIMENT

With reference to the figures, preferred embodiments of the invention shall now be explained in more detail.

Figure 1A:
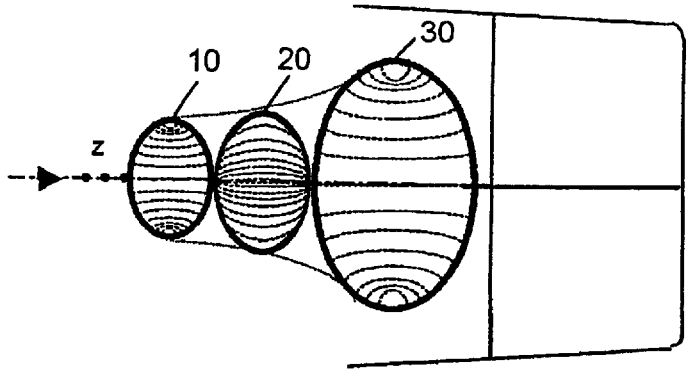
FIG. 1*a* shows the field shape of the deflection field that is variable in the Z-direction, for the vertical deflection direction.
Figure 1B:
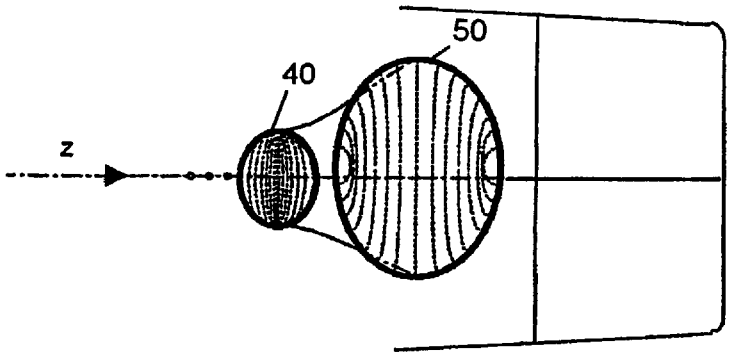
FIG. 1*b* shows the field shape of the deflection field that is variable in the 7-direction, for the horizontal deflection direction.
Figure 1C:
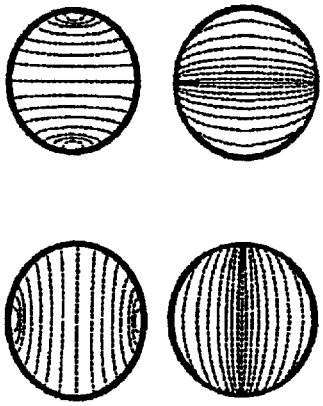
FIG. 1*c* illustrates the pincushion-shaped and barrel-shaped deflection fields in the horizontal and vertical deflection direction.
Figure 2:
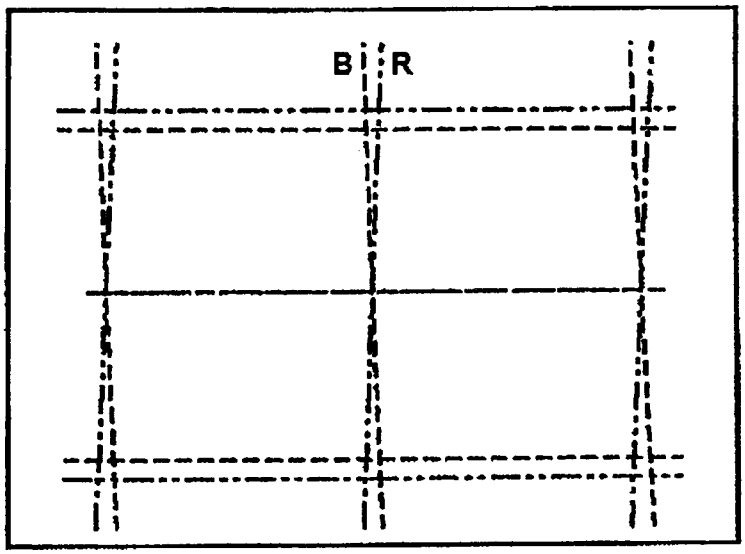
FIG. 2 is an illustration of a convergence error created by construction tolerances in the picture tube and the deflection unit.
Figure 3A:
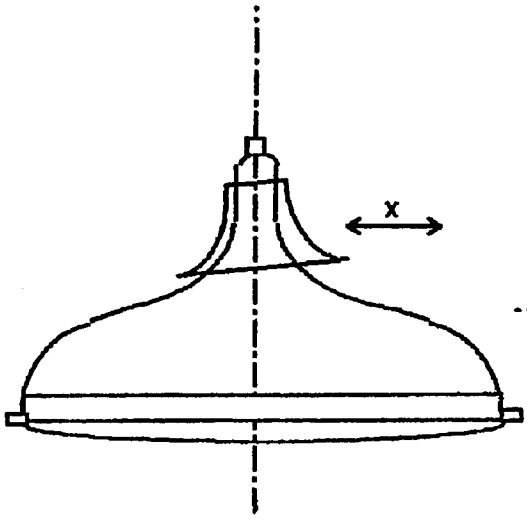
FIGS. 3*a* and *b* illustrate the conventional tilt correction of convergence errors in the X and Y-direction.
Figure 3B:
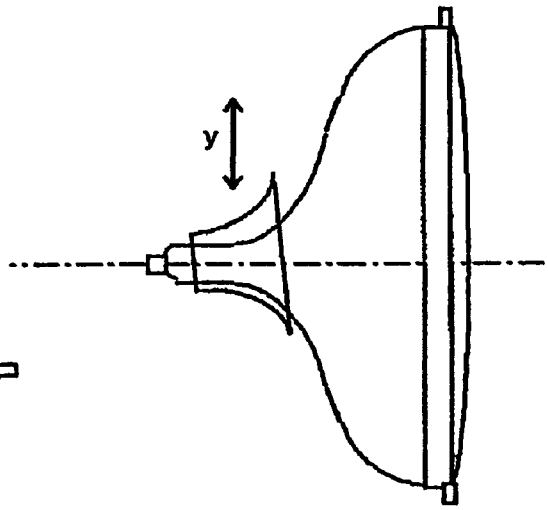
Fig. 3b Prior Art
Figure 4A:
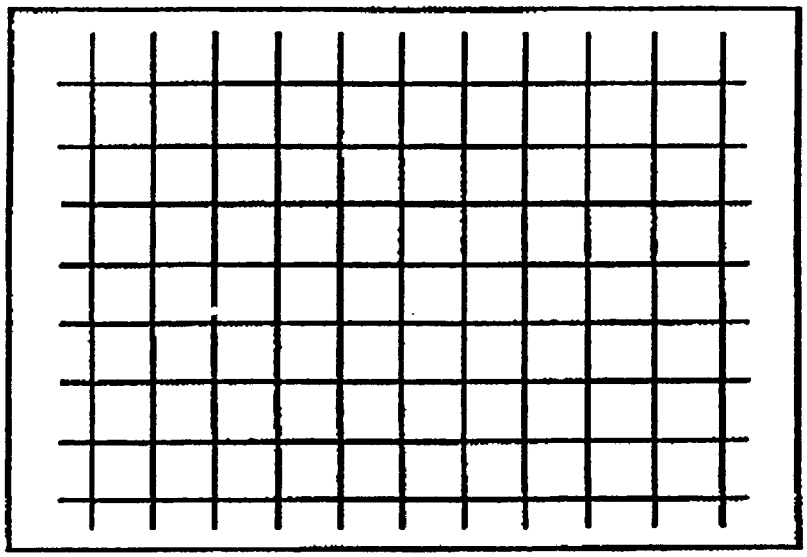
FIG. 4*a* is an illustration of the ideal raster.
Figure 4B:
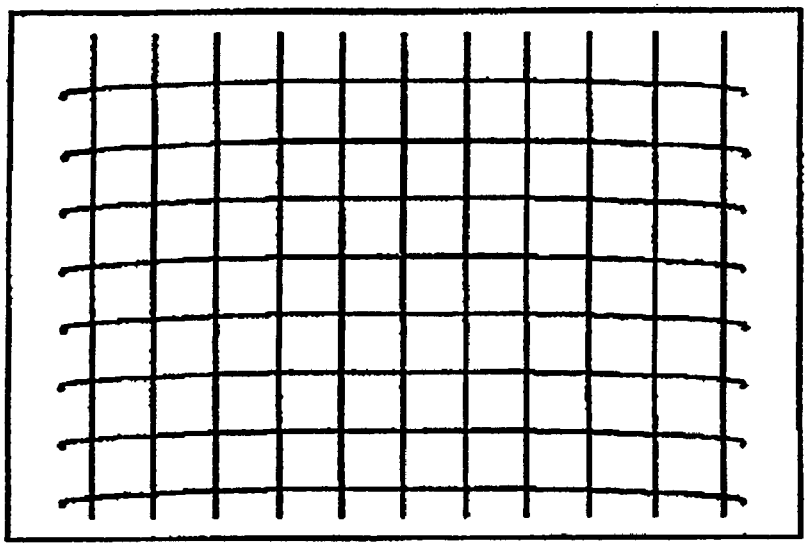
FIG. 4*b* is an illustration of a raster with asymmetrical geometry errors by tilting the deflection unit in the Y-direction.
Figure 5:
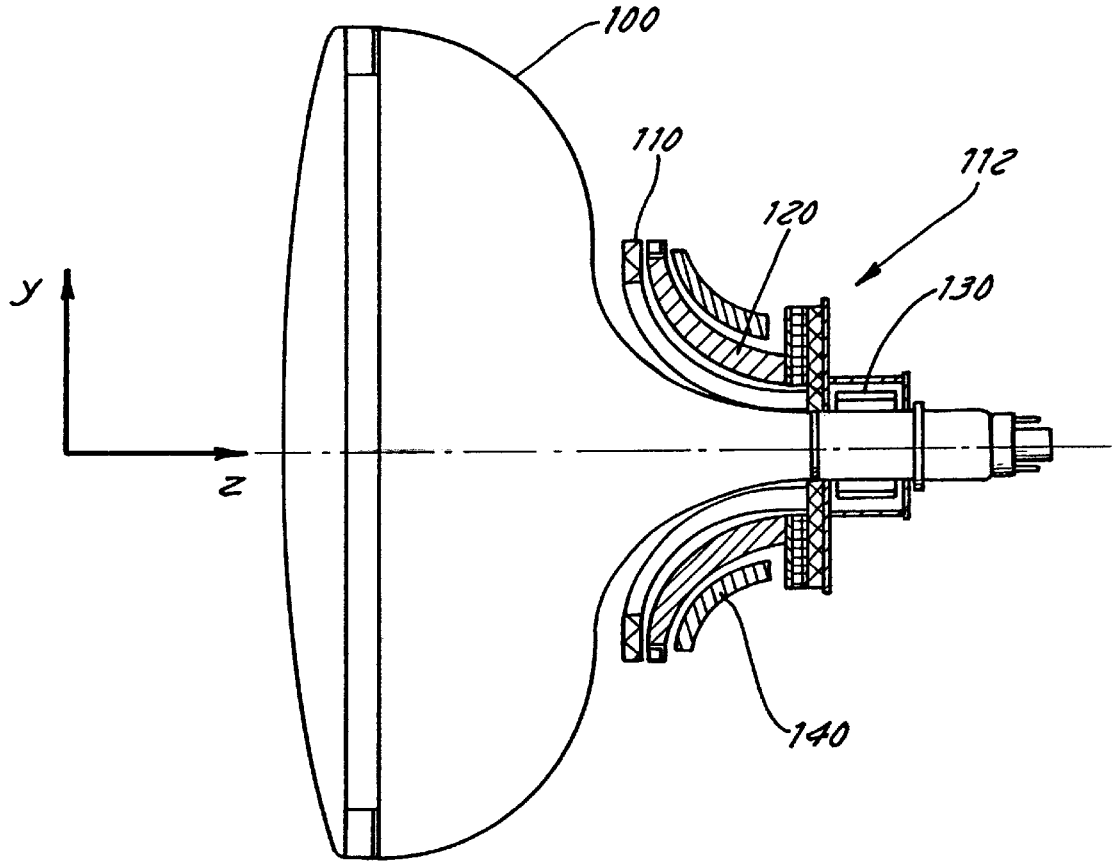
FIG. 5 shows an embodiment of a deflection unit mounted on a color cathode ray tube, in a sectional view.

FIG. 5 shows a color cathode ray tube with mounted-on deflection unit in a sectional view. The deflection unit mounted on the neck of the color picture tube 100 first comprises a horizontal coil 110, a vertical coil 112, and a ferrite core 140. As can be seen in the figure, the vertical coil 112 is divided into a front coil part 120 and a rear coil part 130. A geometry error canbe corrected and adjusted by means of the front coil part 120. The rear coil part 130 permits the independent correction of convergence errors, such as a coma error.

Figure 6A:
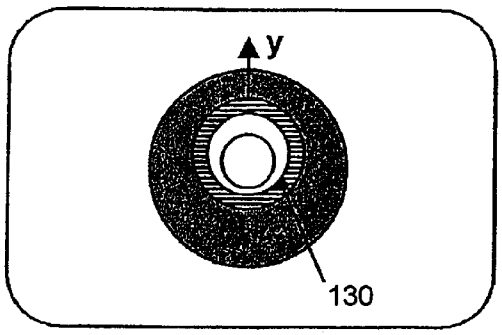
FIG. 6*a* is a sectional illustration with view in the Z-direction for illustrating the convergence error correction by way of a Y-movement.
Figure 6B:
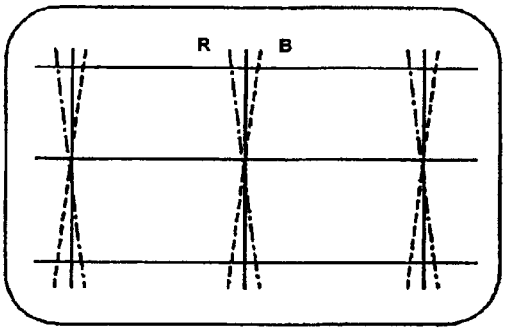
FIG. 6*b* is an illustration of the convergence error which can be corrected by the arrangement of FIG. 6*a;*
Figure 7A:
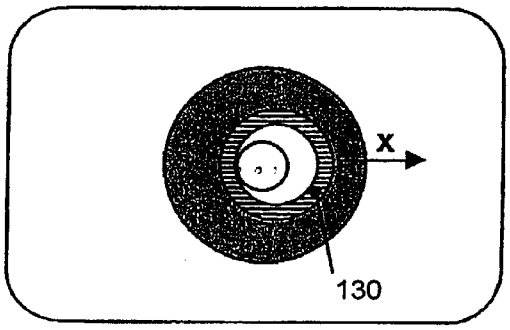
FIG. 7*a* shows an arrangement, corresponding to the illustration of FIG. 6*a,* for a correction in the X-direction.
Figure 7B:
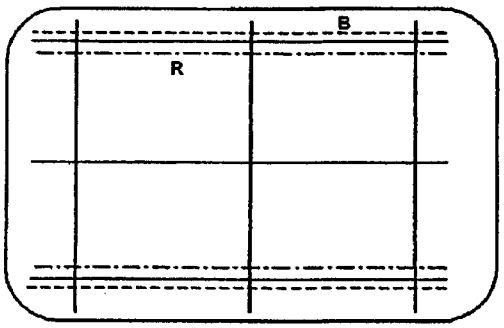
FIG. 7*b* illustrates the convergence error which can be corrected by said arrangement.

The convergence error correction by the arrangement shown in FIG. 5 shall now be explained in more detail with reference to FIGS. 6 and 7. FIG. 6*a* shows a vertical coil 130 displaced in the Y-direction, whereby the convergence errors shown in FIG. 6*b* can be corrected without producing geometry errors. In the arrangement shown in FIG. 7*a,* the rear vertical coil part 130 is displaced in X-direction, which permits the correction of another convergence error illustrated in FIG. 7*b.*

Although in the described embodiment the pair of vertical coils is subdivided, the pair of horizontal coils can be subdivided in another embodiment of the invention. In a further preferred embodiment of the invention the two pairs of coils are subdivided, resulting in different correction characteristics.

In a further preferred embodiment the respective pair of coils is not only divided into two parts. Rather, a further improved error correction and convergence or geometry adjustment can be achieved in a preferred manner by subdivision into three or more parts.

The invention can preferably be employed in saddle-saddle deflection units, but also in saddle-toroidal deflection units. Preferably, the invention is employed in "pure-flat" type color picture tubes.

What is claimed is:

1. A deflection unit for mounting on a color cathode ray tube, comprising:

a first pair of coils for vertical deflection, and a second pair of coils for horizontal deflection, wherein at least one of the pairs of coils is subdivided into at least two mechanically independent parts which are configured such that one part corrects convergence errors and the other part corrects geometry errors, and wherein the respective corrections are carried out independently of one another.

2. The deflection unit according to claim 1, wherein the at least two parts are spatially separated and the other part is configured to be positioned closer to a screen of the color cathode ray tube than the one part.

3. The deflection unit according to claim 1, wherein the subdivided pair of coils is the second pair of coils.

4. The deflection unit according to claim 1, wherein the subdivided pair of coils is the first pair of coils.

5. The deflection unit according to claim 1, further comprising means for the fine adjustment of the convergence error correction and/or the geometry error correction.

6. The deflection unit according to claim 1, wherein the deflection unit is equipped for use with an in-line type color picture tube.

7. The deflection unit according to claim 1, wherein the deflection unit is a saddle-toroidal deflection unit.

8. The deflection unit according to claim 1, wherein the deflection unit is a saddle-saddle deflection unit.

9. A color cathode ray tube comprising a deflection unit according to claim 1.

10. A display apparatus comprising a color cathode ray tube and a deflection unit according to claim 1.

11. The deflection unit as recited in claim 1, wherein one of the parts is configured to be displaced relative to another of the parts so as to correct for convergence errors.

12. The deflection unit is recited in claim 11, wherein the one part is configured to be displaced in two mutually perpendicular directions relative to the another part to correct two different types of convergence errors.

13. A color cathode ray tube comprising a deflection unit that includes a first pair of coils for vertical deflection, and a second pair of coils for horizontal deflection, wherein at least one of the pairs of coils is subdivided into at least two mechanically independent parts which are configured such that one part corrects convergence errors and the other part corrects geometry errors, and wherein the respective corrections are carried out independently of one another.

14. A display apparatus comprising a color cathode ray tube; and a deflection unit that is mounted on the cathode ray tube and that includes a first pair of coils for vertical deflection, and a second pair of coils for horizontal deflection, wherein at least one of the pairs of coils is subdivided into at least two mechanically independent parts, which are configured such that one part corrects convergence errors and the other part corrects geometry errors, and wherein the respective corrections are carried out independently of one another.

15. A display apparatus of claim 14, wherein the cathode ray tube includes a screen, and wherein the other part is positioned closer to the screen than the one part.

* * * * *